US008610040B2

(12) United States Patent
Farachi et al.

(10) Patent No.: US 8,610,040 B2
(45) Date of Patent: Dec. 17, 2013

(54) ELECTRIC INDUCTION OVEN

(75) Inventors: Francesco Farachi, Inarzo (IT); Rocco Galli, Travedona Monate (IT); Davide Gerola, Comerio (IT); Fabrizio Dughiero, Piove di Sacco (IT)

(73) Assignee: Whirlpool Corporation, Benton Harbor, MI (US)

( * ) Notice: Subject to any disclaimer, the term of this patent is extended or adjusted under 35 U.S.C. 154(b) by 731 days.

(21) Appl. No.: 12/556,885

(22) Filed: Sep. 10, 2009

(65) Prior Publication Data

US 2010/0059513 A1 Mar. 11, 2010

(30) Foreign Application Priority Data

Sep. 11, 2008 (IT) ..... MI2008A1617

(51) Int. Cl.
*H05B 6/64* (2006.01)

(52) U.S. Cl.
USPC ..... 219/756; 219/600

(58) Field of Classification Search
USPC ..... 219/600–677, 756, 391–414
See application file for complete search history.

(56) References Cited

U.S. PATENT DOCUMENTS

| | | | | |
|---|---|---|---|---|
| 3,632,944 | A | 1/1972 | Lease | |
| 3,745,290 | A * | 7/1973 | Harnden et al. | 219/621 |
| 3,790,735 | A | 2/1974 | Peters, Jr. | |
| 4,435,900 | A * | 3/1984 | de Wilde | 29/603.14 |
| 5,134,265 | A * | 7/1992 | Dickens et al. | 219/621 |
| 5,272,317 | A * | 12/1993 | Ryu | 219/403 |
| 7,026,587 | B2 * | 4/2006 | Yang et al. | 219/622 |
| 2004/0144773 | A1 * | 7/2004 | Kim et al. | 219/601 |
| 2009/0143797 | A1 * | 6/2009 | Smith et al. | 606/169 |

FOREIGN PATENT DOCUMENTS

| | | |
|---|---|---|
| DE | 19852617 | 1/2000 |
| DE | 19853780 | 1/2000 |
| DE | 10160086 | 7/2002 |
| JP | 4319288 | 11/1992 |
| JP | 6018044 | 1/1994 |

* cited by examiner

*Primary Examiner* — Tom Thomas
*Assistant Examiner* — Nicholas J Choi

(57) ABSTRACT

An electric oven includes a box casing presenting side walls, a rear wall, an upper wall and a lower wall, an opening and a closure door for this latter, the walls bounding an oven cavity heated by heating structure functionally associated with at least one of the walls. The heating structure is arranged to heat the cavity by induction and includes a generator arranged to generate an electromagnetic field, an electrically insulating material disposed between the generator and the oven wall at which the heating structure is positioned, and magnetically insulating structure is disposed on the outside of the oven with reference to the wall, the generator, the electrically insulating structure and the magnetically insulating structure defining a single, layered structure fitted to the oven wall.

14 Claims, 2 Drawing Sheets

ELECTRIC INDUCTION OVEN

BACKGROUND OF THE INVENTION

1. Field of the Invention

The present invention relates to an oven in accordance with the introduction to the main claim.

2. Description of the Related Art

An oven is known to comprise a box structure or casing defined by a plurality of walls bounding an oven cavity for receiving the food to be prepared.

This structure is open on one side, at which a movable door is located, providing access to the cavity.

With particular reference to electric ovens, their cavity is heated using heating means positioned at least one wall of their structure. These heating means are usually electrical resistance elements positioned generally at an upper wall or at a lower wall of the box structure or casing.

In the household electrical appliance field, and in particular in cooking hobs, it is also known to use induction technology to heat a container positioned above (if not in contact with) electromagnetic field generator means.

This field generates heating of the base structure of the container, to result in general heating of this latter and of its contents.

SUMMARY OF THE INVENTION

An aspect of the invention is to provide an electric oven in which, in a manner safe for the user, induction technology is used to heat its cavity and whatever is disposed therein.

Another aspect of the invention is to provide an oven of the stated type which is of simple construction and enables its components to be easily stored, either on the manufacturers premises or elsewhere, for its production, or for maintenance or for replacement of damaged parts.

Yet another aspect is to provide an oven of the stated type, in which the manner of constructing the box structure or casing which bounds and defines its internal cavity is totally identical to that of currently available ovens.

A further aspect is to provide an oven of appearance substantially identical to that of currently available ovens, hence enabling it to be inserted into kitchen cabinets in the same manner as those used for currently available ovens.

Another aspect is to provide an oven of the stated type which is safe for the user, both electrically and in terms of the heat transmitted outwards from the oven, for example towards the cabinet which contains it.

These and other aspect which will be apparent to the expert of the art are attained by an oven in accordance with the accompanying claims.

BRIEF DESCRIPTION OF THE DRAWINGS

The present invention will be apparent from the accompanying drawings, which are provided by way of non-limiting example and in which.

DETAILED DESCRIPTION OF THE PREFERRED EMBODIMENTS

Figure 1:
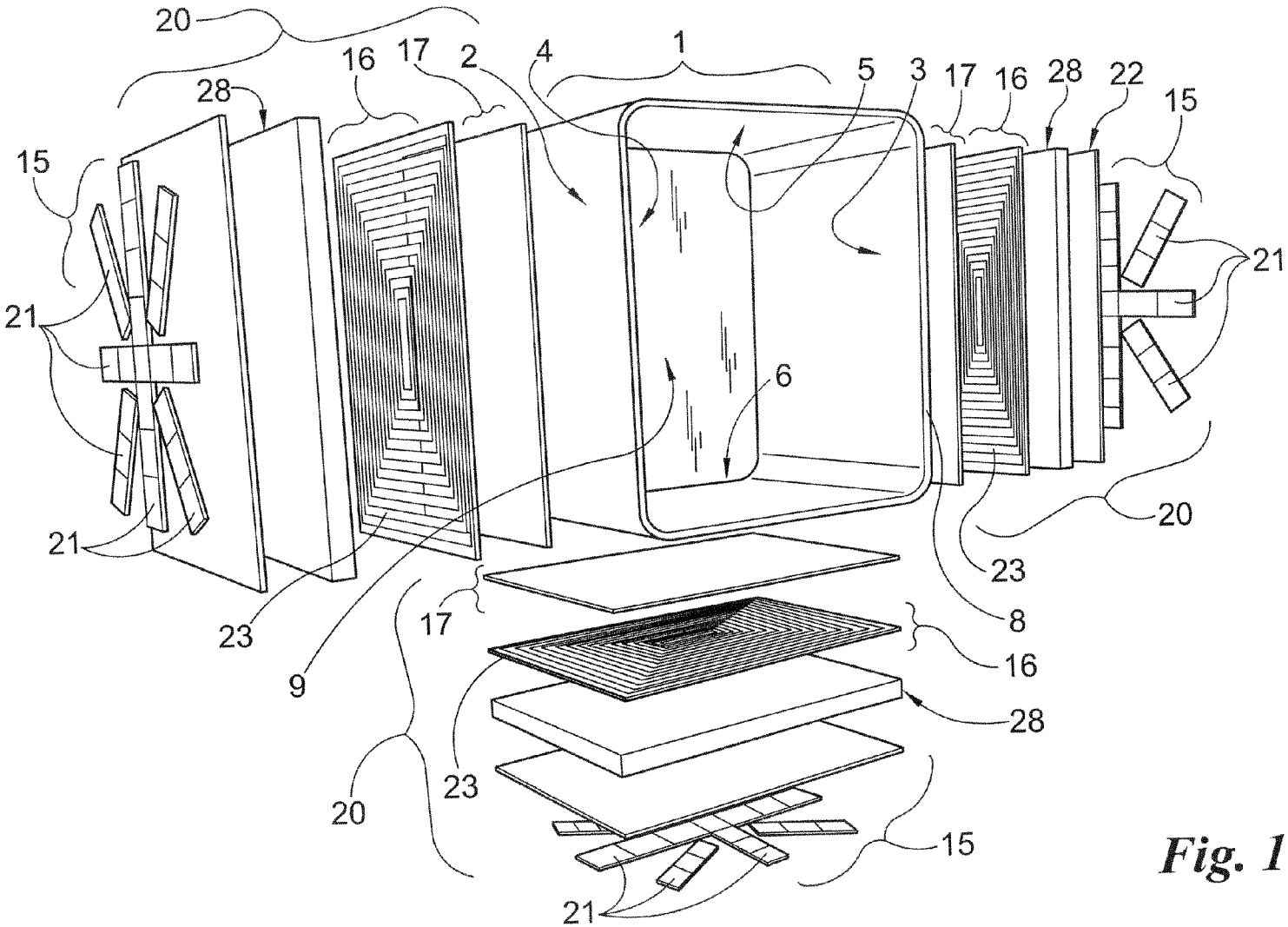
FIG. 1 is a schematic exploded view of an oven in accordance with the present invention.

With reference to the figures, an oven according to the invention comprises a box structure or casing 1 presenting side walls 2, 3, a rear wall 4, an upper wall 5 and a lower wall

6. This casing presents an opening 8 giving access to an oven cavity 9 bounded and defined by the walls, the opening being closable by a door (not shown in the figures). The oven comprises heating means to heat the cavity 9 and its contents for their preparation, for example the cooking of a food contained in a pan, the heating means being positioned at least one of the aforesaid walls of the casing 1.

According to the invention, these means are induction heating means, i.e. electrically powered means generating a magnetic field which heats the (metal) walls of the corresponding oven. More particularly, the heating means comprise principally (with reference to the wall 2 shown in FIG. 1, starting from the left and moving towards the casing 1) a magnetically insulating member 15, electrically powered means 16 generating a magnetic field and electrically insulating 17 positioned between the means 16 and the corresponding wall of the oven casing 1. Advantageously, these means 15, 16 and 17 are connected together to form a single sandwich or layered structure 20 which is easy to handle and to fit to the corresponding oven wall.

More particularly, the magnetically insulating means 15 are positioned in that part of the structure 20 most distant from the oven wall to which this latter is fixed.

In detail, the term "magnetically insulating means" indicates structures comprising materials with ferromagnetic properties presenting a high electrical resistivity.

Figure 2:
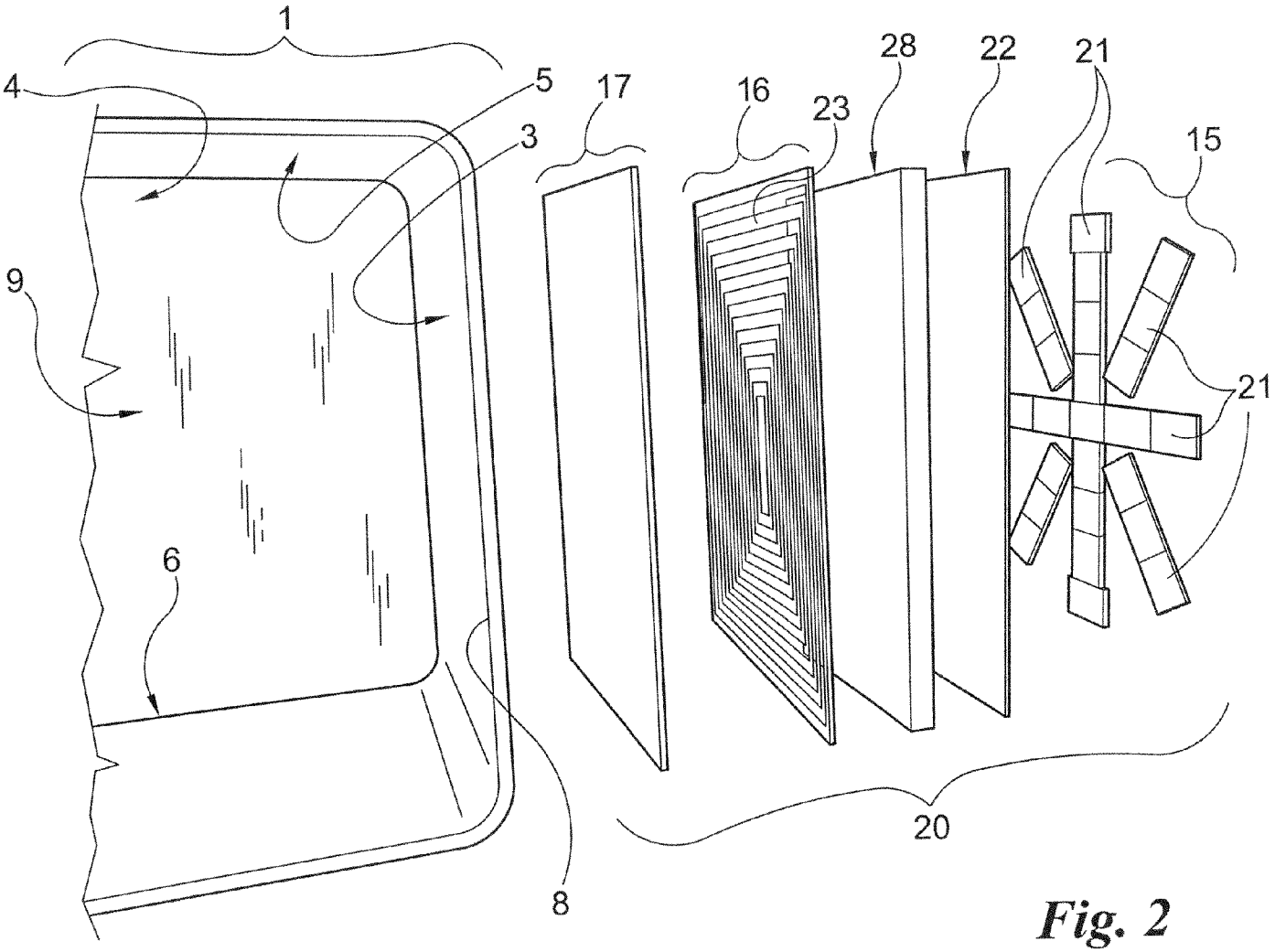
FIG. 2 is an enlarged view of a detail of FIG. 1.

These means comprise a panel or a plurality of panels or tiles 21 of ferrite (or equivalent magnetically insulating material) having very low thermal dispersion, carried by a supporting panel 22 for example made of mica or an equivalent material (such as Cogetherm of the Jaco company), or of resin, plastic or the like. The purpose of these tiles 21 is to screen whatever surrounds the oven (on the side of the wall to which the heating means 10 are fitted) from the electromagnetic radiation generated by the generator means 16. The arrangement of the ferrite tiles 21 shown in FIGS. 1 and 2 is merely indicative and can be more accurately studied on the basis of the shape and number of turns of the generator means 16, to prevent electromagnetic field losses towards the oven exterior.

These means 16 are defined by one or more inductors 23 of various shapes (e.g. spiral, square, rectangular, circular, etc.), formed for example of aluminium or copper, disposed generally and preferably as a spiral to occupy an area substantially corresponding to that of the oven wall (2, 3 or 6 in FIG. 1) such as to heat this latter when each inductor is traversed by electric current. The generator means are hence defined by a predetermined number of turns, a number which is a key parameter in adapting the inductor impedance to the heating effect which is to be obtained on the wall. The aforedescribed geometry is not to be considered as limiting. In this respect, multiple generator means (e.g. from 2 to 4) could be used, also of spiral, circular, square, rectangular, etc. geometry, connected in series and/or in parallel on the same wall in order to adequately cover the entire wall and enable greater flexibility in its heating, achieved by altering the powering of the generator means.

The construction of each inductor 23 is also not limited to a round cross-section obtained by plaiting copper or aluminium wires, but can have a rectangular cross-section obtained for example by pressing and/or blanking a metal sheet.

As the generator means 16 are traversed by electric current, oven safety during use is ensured by the electrically insulating means 17 defined by an insulating panel for example of mica or mica-based or equivalent material. In the illustrated example, Cogetherm is again used, an electrically insulating material resistant to high temperatures, although other materials with equivalent/similar properties can be used instead.

As ferrite (or equivalent material) has lesser insulating properties towards the magnetic field as its temperature increases, in order to prevent the heat produced on the oven wall from causing excessive heating of the ferrite thermally insulating means are provided between the generator means 16 and the panel 22 supporting the magnetically insulating means 15. These thermally insulating means are a panel 28 of glass/rockwool or similar thermally insulating material, of adequate thickness for the electromagnetic field generated by the generator means 16. This panel prevents the heating of the oven wall from propagating to the outside of the sandwich structure 20, towards the wall of the kitchen containing the oven or towards the cabinet wall or towards another appliance close to the oven when this is positioned within a kitchen cabinet.

Advantageously, the panel 28 can also be maintained spaced from the generator means 16 and/or from the panel 22 to hence define an air interspace (insulating) between the generator means and adjacent panel 22. By virtue of the invention, a layered or sandwich structure can be formed (comprising the means 15, 16, 17, the panel 22 and the panel 28) which can be easily applied to the oven casing 1. Advantageously, the wall of this latter (the walls 2, 3 and 6 in the example) can comprise a recess or a curvature arranged to contain the layered structure 20. This further facilitates formation of the oven of the invention and does not involve any particular structural modifications to the oven casing 1 for most currently available oven casings or structures.

Finally, a particular embodiment of the invention has been described in which the structure 20 is fitted to some of the walls of the oven casing 1.

However, an expert of the art could decide to fit this structure to only one of these walls, or to all, including that defined by the oven door closing the opening 8 of the oven cavity 9. These variants are also to be considered as falling within the scope of the following claims.

We claim:

1. An electric oven comprising an oven casing presenting side walls, a rear wall, an upper wall and a lower wall, and an opening adapted to be closed by a door, the walls bounding an oven cavity heated by heating means functionally associated with at least one of the walls, wherein the heating means are arranged to heat the cavity by induction, the heating means comprising means for generating an electromagnetic field, means for electrically insulating, and means for magnetically insulting.

2. The oven according to claim 1, further comprising: means for thermally insulating.

3. The oven according to claim 1, further comprising: means for coupling the heating means to a plurality of the walls of the oven casing.

4. An electric oven comprising:

an oven casing defined by opposing side walls, a rear wall, an upper wall and a lower wall which establish an oven cavity, said oven casing having an opening adapted to be closed by a door; and an induction heater unit provided along an outside portion of at least one of the walls of the oven casing for heating the oven cavity by induction, said induction heater unit being defined by a single, layered structure of interconnected panels or tiles including:

one layer defined by a generator arranged to generate an electromagnetic field;

an electrically insulating member layer disposed between the generator and the at least one of the walls of the oven casing; and a magnetically insulating layer.

5. The oven according to claim 4, wherein the induction heater unit further includes a thermal insulating panel positioned between the generator and the magnetically insulating layer.

6. The oven according to claim 5, wherein the induction heater unit is constituted by interconnected panels including a supporting panel upon which the magnetically insulating layer is mounted.

7. The oven according to claim 6, wherein the magnetically insulating layer includes a plurality of interconnected tiles provided on the supporting panel.

8. The oven according to claim 6, wherein the thermal insulating panel is positioned between the generator and the supporting panel.

9. The oven according to claim 5, wherein the thermally insulating panel is spaced from one of the generator and the magnetically insulating layer to define an air interspace between the thermally insulating panel and the one of the generator and the magnetically insulating layer.

10. The oven according to claim 5, wherein the thermally insulating panel is formed of mica.

11. The oven according to claim 4, wherein the magnetically insulating layer comprises a panel of ferrite or magnetically equivalent material.

12. The oven according to claim 4, wherein the magnetically insulating layer comprises a plurality of panels or tiles of ferrite or magnetically insulating materials.

13. The oven according to claim 4, wherein the generator comprises at least one inductor disposed as a spiral to define a surface corresponding to the at least one of the walls of the oven casing to which the induction heater unit is fitted.

14. The oven according to claim 4, wherein the induction heater unit is seated directly upon the at least one of the walls.

* * * * *